United States Patent [19]

Chern

[11] Patent Number: 4,968,168

[45] Date of Patent: Nov. 6, 1990

[54] BALLPOINT PEN WITH CLICKING

[76] Inventor: Hann-Tzong Chern, No. 84, Song-Po St., Panchiao City, Taipei Hsien, Taiwan

[21] Appl. No.: 293,302

[22] Filed: Jan. 4, 1989

[51] Int. Cl.[5] ..... B43K 29/00; B43K 24/00

[52] U.S. Cl. ..... 401/52; 401/194

[58] Field of Search ..... 401/68, 70, 75, 116, 401/194, 52, 65; 446/418, 420

[56] References Cited

U.S. PATENT DOCUMENTS

| | | | |
|---|---|---|---|
| 2,219,769 | 10/1940 | Dorfman | 401/194 |
| 2,693,171 | 11/1954 | Lan | 401/75 X |
| 3,289,636 | 12/1966 | Tessier | 401/75 |
| 4,221,491 | 9/1980 | Malm | 401/75 X |

*Primary Examiner*—Richard J. Johnson

*Attorney, Agent, or Firm*—Lackenbach Siegel Marzullo & Aronson

[57] ABSTRACT

This invention discloses a ballpoint pen which is capable of generating a "click" sound when the first tube of the pen is rotated over either of two predetermined positions. The ballpoint pen includes a first engaging member, a second engaging member, a medium tube, an ink reservoir tube, a sleeve, a compression spring, a support, and a rod. Thus, the main principle of the present invention is to cause a "click" sound to be produced as the ballpoint of the pen is extended or withdrawn, through the interaction of the first and second engaging members when the first tube of the pen is rotated.

10 Claims, 2 Drawing Sheets

BALLPOINT PEN WITH CLICKING

BACKGROUND OF THE INVENTION

This invention relates to a ballpoint pen, and more particularly to a rotatable ballpoint pen capable of generating a "click" sound when the first tube of the pen is rotated to either one of two predetermined positions.

It is well known that rotatable ballpoint pens are commonly used nowadays. However, the known rotatable ballpoint pens still suffer from many defects. For example, the ballpoint of the pen tends to either not the fully extended or not be fully withdrawn, in relation to the pen case, when the pen is in use or at rest. This presents an inconvenience to the user. Another defect becomes obvious when the associated mechanism of the ballpoint of the pen is damaged due to excessive rotation on the part of the user. Thus, an attempt has been made by the applicant to offer a rotatable ballpoint pen which can generate a "click" sound so as to remind or warn the user that the ballpoint of the pen has reached either of two predetermined positions. In view of the features of this invention, it is certain that the aforesaid known defects can be completely overcome.

SUMMARY OF THE INVENTION

It is accordingly a primary object of the present invention to provide a rotatable ballpoint pen which can generate a "click" sound when the first tube of the pen is rotated to either one of two predetermined positions.

It is another object of the present invention to provide a rotatable ballpoint pen which may be enhanced by means of the sound generated thus attracting consumers' interest.

According to the present invention, a ballpoint pen has an elongated outer tube with a first end and a second end, the outer tube being rotatably joined by a first tube at the first end and a second tube at the second end; and an inner tube for a reservoir of ink, having an end with a ballpoint for writing purposes, the inner tube being disposed within the outer tube, protruding the ballpoint from the second end of the second tube, said inner tube being adapted to be axially and reversibly moved by rotating the first tube, enabling the ballpoint to retract into the second end.

The improvement comprises a rod having a first end facing the first end of the outer tube and a second end facing the second end of the outer tube, the rod being disposed within the first tube and adapted to be axially and reversibly moved by rotating the first tube between a first position, where the ballpoint is protruded to a first predetermined place, and a second position, where the ballpoint is retracted to a second predetermired place, said first tube being continuously rotated until the rod reaches one of the predetermined positions; a first engaging means fixedly disposed at the second end of the rod; and a second engaging means fixedly disposed around the inner tube, the second engaging means being biased to make engagement with the first engaging means; whereby a "click" sound can be created when the ballpoint is moved to one of the predetermined places during the rotation of the first tube.

Preferably, the first and second engaging means are made of a metal material so as to create a clear sound resulting from the collision between said two engaging means when the pen is rotated to either one of two predetermined positions during the rotation of the first engaging means and the axial displacement of the second engaging means.

Other advantages and characteristics of the present invention will become clear from the following description of preferred embodiments when read in conjunction with the accompanying drawings.

DETAILED DESCRIPTION OF THE PREFERRED EMBODIMENTS

Figure 1:
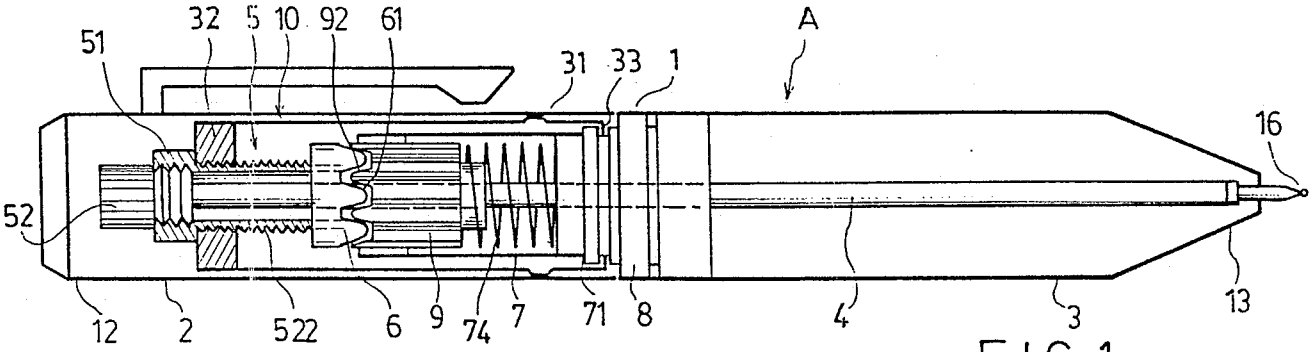
FIG. 1 is a sectional view of a rotatable ballpoint pen according to the present invention showing the condition of the rod of the pen when rotated to a first predetermined position.
Figure 2:
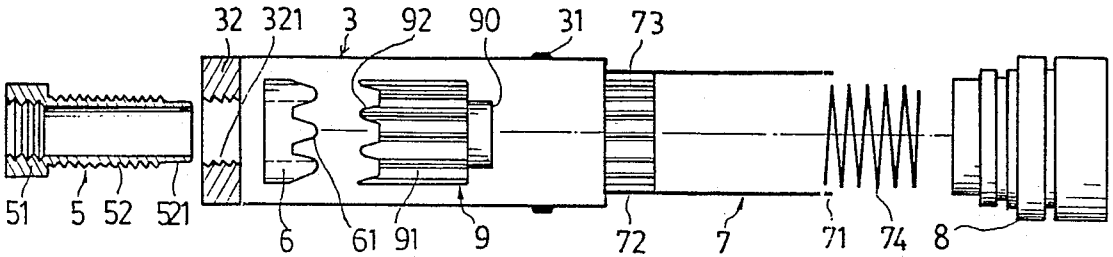
FIG. 2 is an exploded view of a rotatable ballpoint pen according to the present invention.

Referring to FIGS. 1 and 2, a rotatable ballpoint pen A which comprises an elongated outer tube 1, an intermediate tube 10, an inner tube 4, a hollow rod 5, a sleeve 7, an annular connector 8, a first engaging member 6, a second engaging member 9, and a compression spring 74. The outer tube 1 is substantially an elongated tube having a first cap end 12 and a second conical end 13. The outer tube 1 has two sections; a first tubular section 2 with said first end 12 and second tubular section 3 with said second end 13. The connector 8 is fixed in the second tube 3. The intermediate tube 10 which is sleeved within the first tube 2 has one end 32 on which is disposed a female thread 321 for accommodating the male thread 522 on the hollow rod 5, and another end 33 which is rotatably seated in the connector 8. It should be noted that the intermediate tube 10 can be rotated past a pair of bosses 31 provided on the outer surface of the intermediate tube 10 to engage with the first tube 2 when the first tube 2 is rotated in a direction opposite to the second tube 3. The inner tube 4 is essentially an ink reservoir tube filled with ink, having a pointed end with ballpoint 16 for writing purposes. The inner tube 4 disposed within the outer tube 1 can project the ballpoint 16 from the second conical end 13 of the second tube 3 and be and be axially reversibly moved forward and back by rotating the first tube 2 so as to retract the ballpoint 16 into the second tube 3. The ink reservoir tube 4, which passes through the connector 8, the compression spring 74, the second engaging member 9, the first engaging member 6, and the hollow rod 5, is connected at one end to a cap 52. All the aforesaid members are hollow members which may be passed through by the ink reservoir tube 4. In addition, the hollow rod 5 has a first enlarged end 51 contacts the outside of end 32 of the medium tube 10 and a second position, in which the first engaging member 6 contacts the inside of end 32 as the intermediate tube 10 is rotated, together with the first section 2. Cap 51 at the first outer end of hollow rod 5 limits the forward axial movement of the rod 5. In addition, the connector 8 is placed between the first tubular section 2 and the second tubular section 3 to serve as a blocking means, preventing the first tubular section 2 from entering the second tubular section 3.

Figure 3:
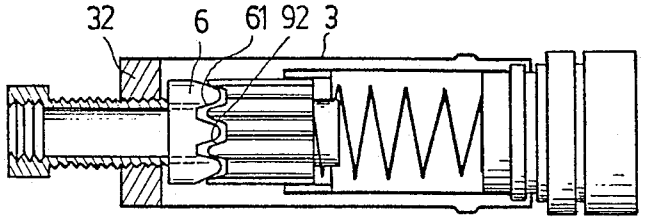
FIG. 3 is a sectional view of a rotatable ballpoint pen showing the condition of the rod of the pen when withdrawn to the second predetermined position.

The first engaging member 6 is fixedly mounted on the threaded end 522 of the hollow rod 5. In addition, the second engaging member 9 is externally mounted to the inside of sleeve 7 around the ink reservoir tube 4 and is forced by spring 74 seated in base 90 to engage with the first engaging member 6 of engaging member 9. First engaging member 6 and second engaging member 9 are seated together by the interlocking of two annular toothed racks 61. 92, as shown in FIGS. 1 and 3. Compression spring 74 is held within sleeves 7, one end of which is engaged to connector 8 and the other end of which is engaged to the second engaging member 9, thereby biasing the second engaging member 9 to engage with the first engaging member 6. It should be noted that the second engaging member 9 has a plurality of tongues 91 formed at its outer surface so as to slide along the grooves 73 disposed internally at the one outer first end of sleeve 7.

In operation, as shown in FIG. 1, hollow rod 5 is thrust to its first extended limiting position by turning the first tubular section 2 so that the ballpoint 16 is completely extended out from the second tubular section 3. Turning of the first tubular section 2 causes the rod 5 to rotate so that the first engaging member 6 rotates and clashes with the second engaging member 9 which is fixed. A "clicking" sound is thereby created. Similarly, when hollow rod 5 is in its second withdrawn limiting position, the first engaging member 6 rotates and clicks with fixed engaging member 9 as shown in FIG. 3.

The first and second engaging members 6, 9, are preferably made of metal material to create a "clicking" sound. Preferably, the ballpoint pen is constructed so that ballpoint 16 extends out from tapered seated end 13, when the first tubular section 2 is rotated clockwise and ballpoint 16 is withdrawn into the second tubular section 3 when the first tubular section 2 is rotated counterclockwise.

Figure 5:
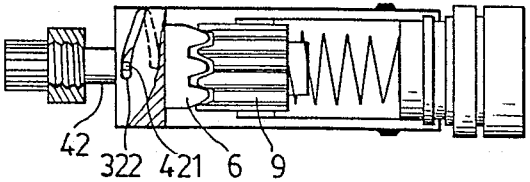
FIG. 5 is a sectional view of another embodiment of a rotatable ballpoint pen according to the present invention showing the condition of the rod of the pen when moved to the second predetermined position.
Figure 6:
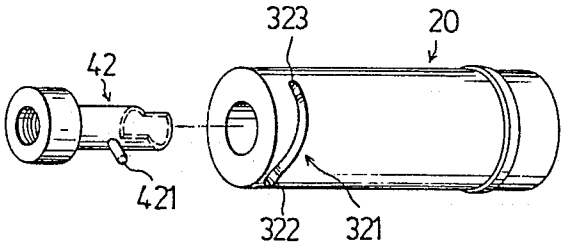
FIG. 6 is an exploded view of a rod and a medium tube of another embodiment according to the present invention.
Figure 4:
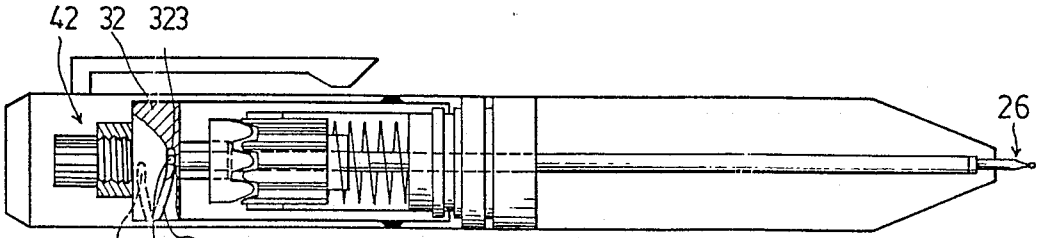
FIG. 4 is a sectional view of another embodiment of a rotatable ballpoint pen according to the present invention showing the condition of the rod of the pen when moved to the first predetermined position.

FIGS. 4, 5 and 6 show another embodiment of a ballpoint pen of the present invention. As shown in the drawings, a hollow rod 42 has a helical bar 421 protruding at its lower outer end so as to slide along helical slot 321 of the intermediate tube 20. Slot 321 is in the shape of a partial helix and has an upper limit position 322 and a lower limit position 323 as shown in FIG. 4. On the contrary, the ballpoint 26 is fully withdrawn into the chamber of the pen when the bar 421 of the hollow rod 42 is slid to the upper limit position 322 as shown in FIG. 5. When the bar 421 is moved from upper limit position 322 to lower limit position 323, intermediate tube 20 rotates rather than moving axially. Similarly, a "clicking" sound can be created as the first engaging member 6' clashes the second engaging member 9'.

While certain preferred embodiments have been described above, it will be readily apparent to those skilled in the art that a number of other modifications and changes can be made without departing from the scope of the invention.

What is claimed is:

1. A rotatable, dual-sectional ball point pen to produce clicking sounds upon adjustment comprising:

(a) an outer barrel having a cylindrical connecting first end and a conical tip second end;

(b) an annular connector adapted to fit inside the outer barrel at its first connecting end, said annular connector having on its side opposite the outer barrel side first seating means for holding biasing means and second inner annular seating means and third outer annular seating means;

(c) a non-rotatable sleeve adapted to fit the second inner annular seating means of the connector at one end and adapted to hole a fixed engaging member at its other end;

(d) biasing means inside the non-rotatable sleeve adapted to seat into at one end the biasing seating means of the annular connector;

(e) an annular fixed engaging member adapted to fit into the non-rotatable sleeve at its holding end and thereby seat the biasing means at its end opposite the annular connector;

(f) an intermediate tube fitted at one first end to seat into the third outer annular seating means of the annular connector, also surrounding the non-rotatable sleeve, and fitted at the opposite second end with a tapped hole;

(g) a rotatable hollow rod adapted to fit into the tapped hole at the second end of the intermediate tube, having axial limiting means upon rotation;

(h) a cap at the first outer end of the rotatable hollow rod so that rotating the cap rotates the rotatable hollow rod;

(i) an annular rotatable engaging member fitted onto the second inner end of the rotatable hollow rod and adapted to engage the annular fixed engaging member when the fixed engaging member is biased into the rotatable engaging member;

(j) at least two small bosses externally on the intermediate tube; and (k) an inner tubular ink reservoir having a ball point extendable outside the second conical tip end of the outer barrel extending through the annular connector, through the biasing means; through the fixed annular engaging member, through the rotatable annular engaging member, through the rotatable hollow rod and fixed into the cap;

whereby rotating the cap of the hollow rotatable rod in one direction moves the hollow rod and the rotatable engaging member to its inner limit against the biasing means of the fixed engaging member and rotating the cap in the opposite direction moves the rotatable engaging member and the hollow rod to its limit in the same direction as the force of the biasing means, the engaging means making a clicking sound as they engage and disengage and as they reach either limit of rotation and hence axial movement of the hollow rod and the rotating engagement means.

2. A rotatable ball point pen as in claim 1, wherein the engaging members have annular crowns of teeth.

3. A rotatable ball point pen as in claim 2, wherein the annular crowns of teeth of the fixed and rotatable, engaging members are of metal whereby upon engaging and disengaging an audible clicking sound is made.

4. A rotatable ball point pen as in claim 1, wherein the biasing means is a spring.

5. A rotatable ball point pen as in claim 1, wherein the hollow rod is externally threaded to fit into the tapped hole at the cap end of the intermediate tube so that inward axial motion of the hollow rod is stopped at its limit by the cap and outward axial motion of the hollow rod is stopped at its limit by the rotatable engaging member against the cap end of the intermediate tube.

6. A rotatable ball point pen as in claim 1, wherein the first seating means of the annular connector for the biasing means is an annular cup, the second seating means of the annular connector is a larger annular groove, and the third seating means of the annular connector is an annular groove.

7. A rotatable ball point pen as in claim 1, wherein the at least two small protrusions on the exterior of the intermediate tube frictionally support a removable capping barrel adapted to cover the cap and intermediate tube and said capping barrel is provided with a clip to hold the ball point pen to a planar surface.

8. A rotatable ball point pen as in claim 1, wherein the interior surface of the non-rotatable sleeve is adapted to frictionally hold the fixed engaging member on its exterior surface by slidable tongue and groove means.

9. A rotatable ball point pen as in claim 1, wherein the rotatable engagement means comprises a radial pin projecting from the external surface of the rotatable hollow rod and the fixed engagement means comprises a helical groove in the interior of the sleeve adapted to receive the rotatable radial pin.

10. A rotatable ball point pen as in claim 9, wherein the radial pin is in the form of a nub.

* * * * *